United States Patent [19]

Bougger

[11] Patent Number: 4,884,053

[45] Date of Patent: Nov. 28, 1989

[54] SURFACE MOUNT WIREWOUND RESISTOR AND METHOD OF MAKING THE SAME

[75] Inventor: Gary E. Bougger, Columbus, Nebr.

[73] Assignee: Dale Electronics, Inc., Columbus, Nebr.

[21] Appl. No.: 236,718

[22] Filed: Aug. 26, 1988

[51] Int. Cl.[4] ..... H01C 1/034

[52] U.S. Cl. ..... 338/275; 338/301; 338/332; 361/404; 361/405; 361/417

[58] Field of Search ..... 338/272, 273, 274, 275, 338/276, 301, 322, 323, 324, 325, 332; 361/400, 403, 404, 405, 406, 417

[56] References Cited

U.S. PATENT DOCUMENTS

| | | | |
|---|---|---|---|
| 3,611,275 | 10/1971 | Leddy et al. | 338/332 X |
| 4,333,069 | 6/1982 | Worth et al. | 338/332 X |
| 4,574,297 | 3/1986 | Ooi | 361/403 X |
| 4,641,222 | 2/1987 | Derfiny et al. | 361/403 |
| 4,672,358 | 6/1987 | Pryst et al. | 338/275 X |

FOREIGN PATENT DOCUMENTS

| | | | |
|---|---|---|---|
| 342223 | 1/1931 | United Kingdom | 338/332 |
| 843014 | 8/1960 | United Kingdom | 338/332 |

*Primary Examiner*—C. L. Albritton
*Attorney, Agent, or Firm*—Zarley, McKee, Thomte, Voorhees & Sease

[57] ABSTRACT

A surface mount wirewound resistor having a conventional wirewound resistor embedded in a plastic body member with terminal axial leads of the resistor being severed at the opposite ends of the body member. A U-shaped metallic terminal pad or clip is secured to the ends of the body member and is in electrical contact with the severed ends of the axial leads. The upper and lower portions of the terminal pad are in coplanar relationship with the upper and lower surfaces of the body member. An alternate surface mount wirewound resistor has metallic tabs that extend from the resistance element embedded in the plastic body member, with the tabs being bent upwardly from the ends thereof and into coplanar relationship with the upper surface of the body member. The method of making a surface mount wirewound resistor entails embodying the resistor having axial leads within a plastic body member, severing the axial leads at the opposite ends of the body member, and then placing terminal pads on the ends of the body member in contact with the severed axial leads. An alternate method suspends the resistor without axial leads between opposite sides of a metallic lead frame by securing the end caps of the resistance element to protruding terminal tabs. The resistance element is then embedded in a plastic body member, the terminal tabs are then severed from the lead frame and bent into coplanar relationship with the upper surface of the body member.

8 Claims, 3 Drawing Sheets

SURFACE MOUNT WIREWOUND RESISTOR AND METHOD OF MAKING THE SAME

BACKGROUND OF THE INVENTION

The present technology for wirewound resistors consists of a cylindrical ceramic core to which metal end caps are attached on each end. Wire terminals are then attached to the metal end caps. Resistance wire is wound around the ceramic core and affixed in some manner to the metal end caps. This unit is then encapsulated using various techniques and encapsulating materials to provide protection to the resistance wire from various environments to which they may be exposed. This is a proven design as evidenced by the excellent reliability these resistors have demonstrated for millions of users in a wide variety of applications. They are known for their high reliability; excellent resistance stability, with low temperature coefficient; and their ability to dissipate large amounts of power utilizing a small package size when compared to other resistor technologies.

A major drawback to this design in today's state of high automation is that this design requires considerable expense by the end customer to install the resistor into a circuit board. The circuit board must have holes placed in it which are suitable in size to accept the resistor terminals. The resistor terminals must then be cut to the proper length and formed in some manner so the terminals may be inserted into the holes in the circuit board. The terminals are then permanently attached to the circuit board using any number of circuit board soldering techniques such as infrared reflow or wave soldering. Circuit board designers utilizing this technology are limited to mounting components on only one side of the circuit board as the resistor terminals protrude through the circuit board.

It is, therefore, a principal object of this invention to provide a surface mount resistor which can be mounted to terminals on a circuit board without creating holes in the circuit board or without cutting the resistor terminals.

It is a further object of this invention to provide a surface mount resistor which can be mounted on either or both sides of the circuit board.

A still further object of the invention is to provide a surface mount resistor which will require less space on the circuit board since the terminals are an integral part of the surface mount component.

A still further object of the invention is to provide a surface mount resistor which is compatible with automated circuit board manufacturing equipment and techniques, and which can be economically manufactured.

A still further object of this invention is to provide a method of manufacturing a surface mount wirewound resistor which is economical and efficient from a manufacturing standpoint.

These and other objects will be apparent to those skilled in the art.

SUMMARY OF THE INVENTION

The invention provides a conventional wirewound resistor (or alternately, a metal film resistor) embedded in a plastic body member with the conventional terminal axial leads of the resistor being severed at the opposite ends of the body member. A U-shaped metallic terminal pad or clip is secured to the ends of the body member and is in electrical contact with the severed ends of the axial leads. The upper and lower portions of the terminal pad are in coplanar or flush relationship with the upper and lower surfaces of the body member.

An alternate form of the invention utilizes metallic tabs that extend from the resistance element embedded in the plastic body member, with the tabs being bent upwardly from the ends thereof and into coplanar relationship with the upper surface of the body member.

The method of making the surface mount wirewound resistor of this invention entails embodying the wirewound resistor in a plastic body member, severing the axial leads of the resistor at the opposite ends of the body member, and then placing U-shaped terminal pads or clips on the ends of the body member in electrical engagement with the severed axial leads.

An alternate method of making the surface mount wirewound resistors of this invention is to eliminate the conventional axial leads of the wirewound resistor and suspend the resistor between opposite sides of a metallic lead frame by securing the end caps of the resistor to protruding terminal tabs which extend inwardly from the opposite sides of the lead frame. The resistance element is then embedded in a rectangular plastic body member. The terminal tabs are then severed from the lead frame, and the terminal tabs are bent into a coplanar relationship with the upper surface of the body member.

BRIEF DESCRIPTION OF THE DRAWINGS

FIG. is a side elevational view of a conventional wirewound resistor.

DESCRIPTION OF THE PREFERRED EMBODIMENT

Figure 1:
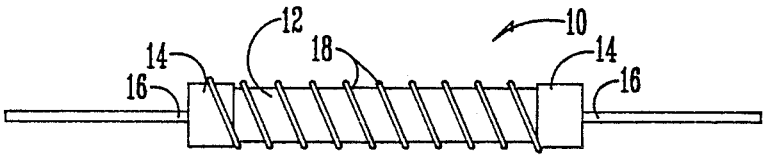
Figure 2:
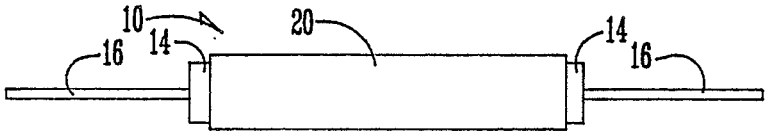
FIG. 2 is an elevational view similar to that of FIG. 1 but shows a coating material over the wirewound resistor.

A conventional wirewound resistor element 10 is shown in FIG. 1 and comprises a cylindrical ceramic core 12 with metal end caps 14 mounted on opposite ends thereof. Metal axial leads 16 are secured to caps 14 and extend outwardly therefrom in alignment with a longitudinal axis of core 12. A resistance wire 18 is wound on core 12 and has the ends thereof electrically connected to the end caps 14. FIG. 2 shows the device of FIG. 1 with a high temperature silicone coating 20 sprayed or otherwise placed thereon. The structure of FIGS. 1 and 2 is conventional in the art and does not, per se, constitute the essence of this invention.

Figure 3:
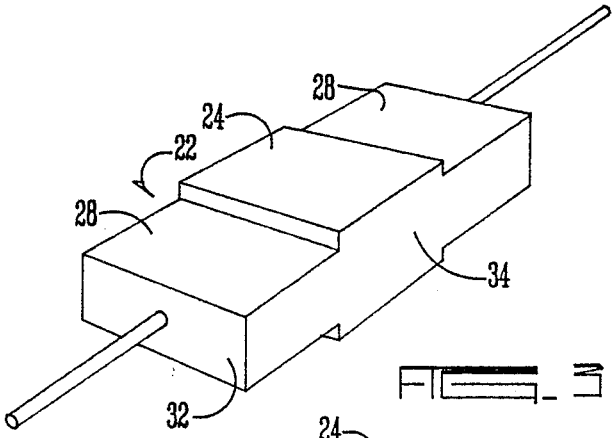
FIG. 3 is a perspective view at a reduced scale of the resistor of FIG. 2 embedded in a rectangular plastic body member.
Figure 4:
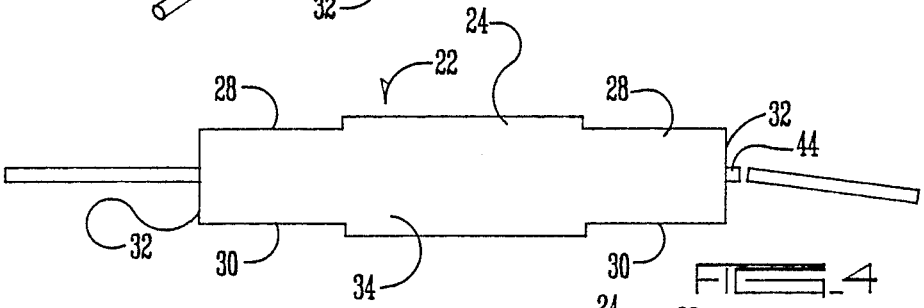
FIG. 4 is a side elevational view of the body member of FIG. 3 with one of the axial lead members shown in the process of being severed.

With reference to FIGS. 3 and 4, the resistor element 10 of FIG. 2 is embedded by conventional means in a high temperature silicone (or epoxy) rectangular body member 22. This embedding process is known in the electrical art and is created in a molding process wherein the resistor 10 is surrounded in a mold by a liquid high temperature silicone material created by subjecting the silicone granules to high conditions of heat and pressure. The shape and configuration of the body member 22 is believed to be novel. Body member 22 has an upper surface 24 and a lower surface 26, both of which comprise the center portions of the body member. Body member 22 also includes upper recess surfaces 28 and lower recess surfaces 30, ends 32, and sides 34.

Figure 5:
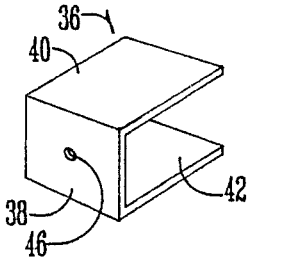
FIG. 5 is a perspective view of a metallic terminal pad or clip to be mounted on the ends of the body member of FIGS. 3 and 4.
Figure 6:
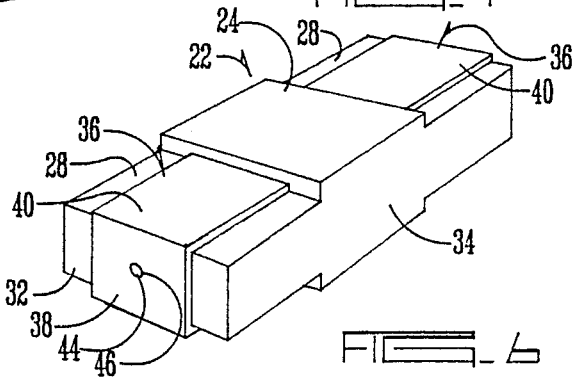
FIG. 6 is a perspective view of the body member of FIG. 3 with the terminal pads of FIG. 5 mounted on opposite ends thereof.
Figure 7:
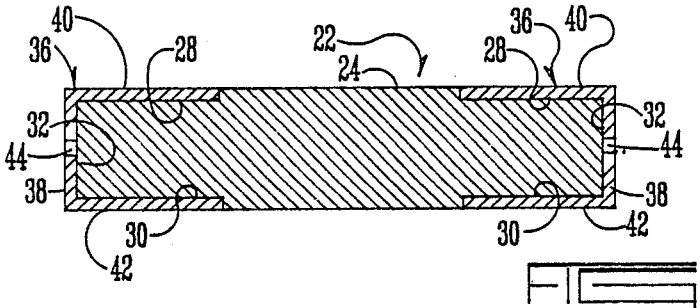
FIG. 7 is a longitudinal sectional view of the body member of FIG. 6 taken on line 7—7 of FIG. 6.

A metallic terminal pad 36 is shown in FIG. 5 and is comprised of a U-shaped clip having a bight portion 38 which integrally extends into horizontal upper and lower legs 40 and 42, respectively. After the body member 22 is formed, the axial leads 16 are severed as shown at the right-hand end of FIG. 4 to create a lead segment 44 that is received in aperture 46 in the bight portion 38 of terminal pad 36. The terminal pads 36 are attached to the ends of the body member 22 by means of soldering, welding, or swaging to ensure electrical continuity. The terminal pads 22 may be covered with a tin-lead solder material (not shown) to ensure easy soldering by the end user.

Figure 8:
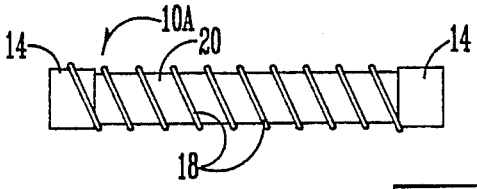
FIG. 8 is an elevational view of a conventional resistor similar to that of FIG. 1 but with the axial leads removed therefrom.
Figure 9:
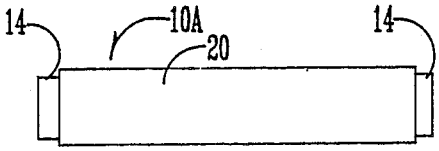
FIG. 9 is an elevational view of a conventional resistor similar to that of FIG. 2 but also with the terminal leads eliminated therefrom.

An alternate form of the invention is shown in FIGS. 8 through 13. A conventional resistor element 10A is shown in FIG. 8, and it is identical to the resistor element 10 shown in FIG. 1, except that the axial leads 16 of FIG. 1 have been eliminated in the device of FIG. 8. FIG. 9 merely shows the high temperature silicone coating 20 added to the structure of FIG. 8.

Figure 10:
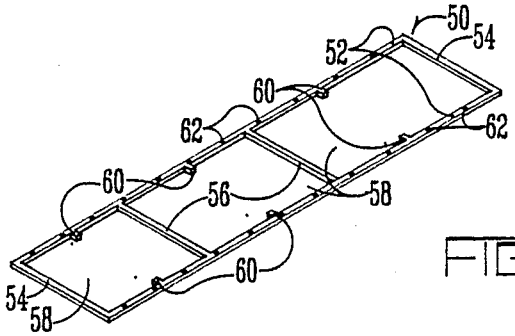
FIG. 10 is a perspective view at a reduced scale of a lead frame used to support the conventional resistor of FIG. 9 during the molding process.
Figure 11:
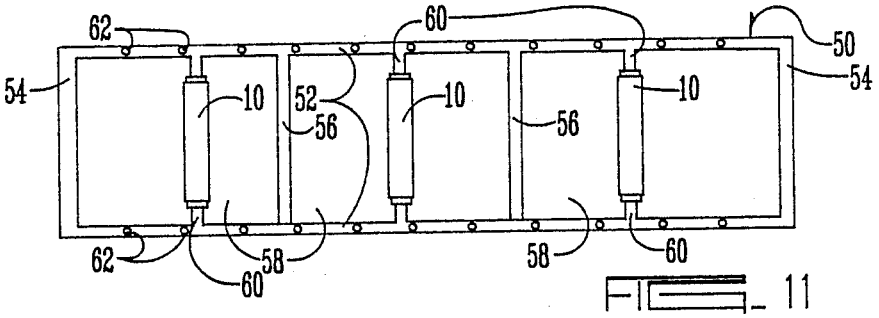
FIG. 11 is a plan view of the lead frame of FIG. 10 with a plurality of resistors of FIG. 9 mounted in supporting condition thereon.
Figure 12:
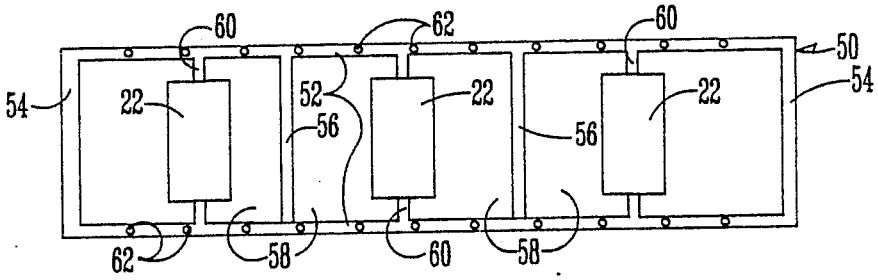
FIG. 12 is a plan view similar to that of FIG. 11 but shows the resistors of FIG. 11 after they are embedded in a rectangular plastic body member.
Figure 13:
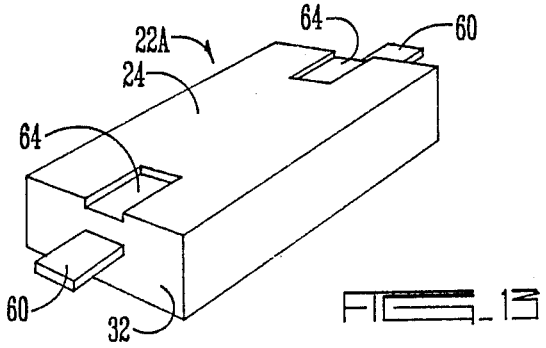
FIG. 13 is a perspective view shown at an enlarged scale of the body members and resistors removed from the lead frame of FIG. 12.

A lead frame 50 is shown in FIG. 10 and is preferably stamped in any desirable length from an elongated sheet of thin copper material. Frame 50 is comprised of sides 52, ends 54, and cross-members 56 which divide the frame into a plurality of open spaces 58. Any desired number of open spaces 58 may be created by varying the length-of frame 50. Lead tabs 60 integrally formed with sides 52 extend inwardly towards the centers of each open space 58. Alignment holes 62 are formed in sides 52 to facilitate the molding process which will be described hereafter.

The resistors 10A shown in FIG. 9 are welded or otherwise secured between opposite lead tabs 60. The lead frame is then placed in a conventional plastic mold and a rectangular body member 22A comprised of high temperature silicone is created by the same molding technique described in regard to body member 22. The body member 22A is essentially identical to the previously described body member 22 except that the recesses 28 and 30 of body member 22 are eliminated and recesses 64 in the upper surface 24 are utilized in lieu thereof.

Figure 14:
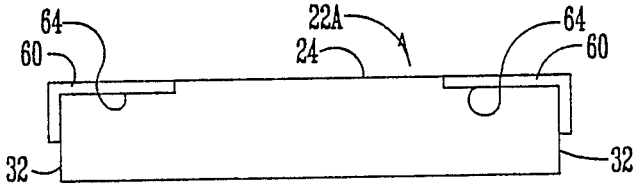
FIG. 14 is a side elevational view of the resistor of FIG. 13 after the terminal tabs have been bent into their preferred position.

After the molding of body member 22A has been completed, the lead tabs 60 are severed from the lead frame 50 so that a substantial length of the lead tabs 60 protrude from the ends of body member 22A. These protruding lead tabs 60 are then bent upwardly and thence horizontally into the recesses 64 as best shown in FIG. 14. Again, the lead tabs 60 can be coated with a tin-lead solder (not shown) to ensure easy soldering by the user.

The rectangular configuration of the body members 22 and 22A helps ensure that the resistor will not have a tendency to tip or move once the resistor is placed on the circuit board. This avoids the problem of cylindrical shaped resistors which are less stable when placed on the circuit board and which often will tip or roll off the board during installation. This occurrence necessitates a rework operation to correctly reposition the resistor on the circuit board. The terminal configuration of the embodiment of FIGS. 8–14, through the laterally wide lead tabs 60 ensures a sufficient solder connection when the resistor is soldered to the circuit board. The wide lead tabs 60 are capable of handling high electrical current which is required with resistance values below 1.0 ohms.

From the foregoing, it is seen that this invention achieves at least all of its stated objectives.

I claim:

1. A surface mount resistor, comprising,
   a substantially hard plastic rectangularly-shaped body member having substantially flat and parallel upper and lower surfaces, opposite sides, and opposite ends,
   an electrical resistance element embedded in said body member and having a pair of spaced terminal ends which extend through said body member and terminate substantially at the exterior surface of said body member,
   and a pair of spaced electrical terminal pads secured to the exterior surface of said body member with one each of said terminal pads being in electrical contact with said one each of said terminal ends.

2. The resistor of claim 1 wherein said spaced terminal ends communicate with the exterior surface of said body member at the opposite ends thereof.

3. The resistor of claim 2 wherein said terminal pads are U-shaped metallic clips that receive the opposite ends of said body member.

4. The resistor of claim 2 wherein said terminal pads are U-shaped metallic clips that receive the opposite ends of said body member and have exposed electrical contact portions adjacent a portion of the upper or lower surfaces of said body member.

5. The resistor of claim 2 wherein metallic clips have a bight portion that engages the ends of said body member, and upper and lower legs that engage a portion of the upper and lower surface, respectively, of said body member adjacent the ends of said body portion.

6. The resistor of claim 5 wherein said body portion is recessed to receive said upper and lower legs of said metallic clips, the upper and lower surfaces of said body member having center portions, respectively, said upper and lower legs having an exposed, flat electrical contact surface that dwells in the same plane as said center portions.

7. The resistor of claim 1 wherein said resistance element comprises a core, a pair of terminal caps on said core and connected to said terminal ends, and an electrical resistance wire wound on said core and connected to each of said terminal caps.

8. The resistor of claim 1 wherein said terminal ends are elongated round members which have their ends secured within apertures within said terminal pads.

* * * * *